United States Patent [19]

Kennedy

[11] Patent Number: 4,651,657

[45] Date of Patent: Mar. 24, 1987

[54] BUTTON ORIENTATING APPARATUS

[76] Inventor: Andrew Kennedy, 72 High Street, Stoke Newington, London, England, N16 7PA

[21] Appl. No.: 676,984

[22] Filed: Apr. 12, 1984

[30] Foreign Application Priority Data

Apr. 12, 1983 [GB] United Kingdom ..... 8309903
Aug. 31, 1983 [GB] United Kingdom ..... 8323365

[51] Int. Cl.[4] ..... D05B 3/22; B23Q 7/15
[52] U.S. Cl. ..... 112/113; 221/160
[58] Field of Search ..... 112/110, 111, 112, 113, 112/104, 106; 221/159, 160, 164, 240, 163

[56] References Cited

U.S. PATENT DOCUMENTS

| | | | |
|---|---|---|---|
| 1,237,315 | 8/1917 | Eby et al. | 221/159 |
| 2,207,077 | 7/1940 | Stott | 112/113 |
| 3,042,254 | 7/1962 | Hendrickson | 112/113 X |
| 3,131,802 | 5/1964 | Miruis | 221/160 |
| 3,175,703 | 3/1965 | Young, Jr. | 112/113 X |
| 3,363,805 | 1/1968 | Prezes | 112/113 X |
| 3,390,812 | 7/1968 | Bono | 112/113 X |
| 3,494,311 | 2/1970 | Hopkins | 112/113 |
| 3,633,524 | 1/1972 | Hoffsommer | 112/113 |
| 3,889,612 | 6/1975 | Hughes et al. | 112/113 |
| 4,050,392 | 9/1977 | Taddicken | 112/113 |

*Primary Examiner*—Werner H. Schroeder
*Assistant Examiner*—Joseph S. Machuga
*Attorney, Agent, or Firm*—Irvin A. Lavine

[57] ABSTRACT

A button support 53 is upwardly biased and is movable along a vertical axis between three positions. Buttons formed with at least two thread holes are orientated by rotary frictional drive means 60 and 61 through effecting relative rotation between the button support 53 and a button 101 which are located by positioning means 13 and 18 positioning a button above the button support. In the lowest position of the button support, the button support is free to rotate about the vertical axis relative to a button 101 located by the positioning means 13 and 18. In an intermediate position the button support together with the button located by the positioning means 13 and 18 are rotatable about the vertical axis. Pins 54 project upwardly from the button support 53 for insertion in the holes of the button so that the button and button support can rotate together. In an upper position, the button support is locked against further rotation so as to provide a support for buttons in the required orientation.

5 Claims, 19 Drawing Figures

BUTTON ORIENTATING APPARATUS

TECHNICAL FIELD

The invention relates to apparatus for orientating buttons for use in automatic sewing machines used for sewing buttons in place.

BACKGROUND ART

In automatic machinery for sewing buttons in place, difficulties arise in ensuring that the buttons are the right way up and arranged with the thread holes aligned with the sewing needle. Moreover, the machines presently provided for this purpose include rapidly moving parts which, being exposed for the transfer of correctly oriented buttons to a sewing machine, present a hazard to operators.

Buttons are normally provided with two or more holes for thread by which the buttons are to be sewn in place and so it is necessary to orientate buttons fed to an automatic sewing machine so that these holes are correctly orientated for receiving the needle of the automatic sewing machine.

In one form of apparatus provided for this purpose, buttons are moved along a track and resiliently loaded clamping means are provided along one side of this track so as to provide frictional engagement with the edges of the buttons so that the buttons are caused to roll along this side of the track and thus caused to rotate. A button support disposed below the track and moved along the track below a button moving on the track is provided with pins for insertion into the holes formed in the button and, as soon as the button rotates to an orientation in which the holes are aligned with the pins, the button support is raised under the influence of resilient loading means so that the pins are inserted into the holes and the button is correctly orientated for transfer to the sewing station. During further movement of the button along the track, rolling movement is prevented.

Unfortunately, this form of apparatus is unsuitable for use with non-circular buttons and is even unsuitable for circular buttons in which the edges of the rim engaged by the resiliently loaded clamping means are irregular in shape and therefore unsuitable for uniform frictional engagement with the clamping means.

One known form of apparatus which has been devised to meet this deficiency comprises an upwardly biased button support; pins projecting upwardly from the button support, for insertion in the holes in a button; positioning means for positioning a button above the button support; and rotary frictional drive means for effecting relative rotation between a button on the positioning means and the button support until the holes in the button are aligned with the buttons on the button support to thereby permit the button support to raise and the pins to enter the holes.

In this known apparatus, the button support is non-rotational and the rotary frictional drive means comprise a rotatable pad which is movable into and out of frictional engagement with a button on the positioning means. As soon as the pins on the button support penetrate the holes in the button, the button is held correctly orientated for transfer to the sewing machine and so the frictional resistance to relative movement between the pad and the button is overcome.

Although this form of apparatus avoids the deficiencies of earlier designs, difficulty is encountered in placing each successive button on the positioning means centrally on the axis of rotation of the rotatable pad. Clearly, this deficiency is most acute when handling non-circular buttons and it is an object of the invention to overcome this deficiency.

In order to transfer the correctly orientated buttons from the orientating apparatus to the sewing machine, where they are clamped in position so that the needle of the sewing machine can penetrate the holes in each button, it is known to provide a button transfer apparatus comprising an upwardly biased radius arm having a free end and support means permitting rotary oscillation about a vertical axis; a button support mounted at the free end of the radius arm and provided with upwardly extending pins for insertion into the holes in buttons; rotary drive means for effecting rotary oscillation of the radius arm about the vertical axis between first and second angular positions in which the button support is able to engage a correctly orientated button and in which a button engaged by the button support can be clamped in a sewing machine; and rectilinear drive means for lowering the radius arm from a first level to a second level when the radius arm is in its second angular position and for enabling the radius arm to rise from the second level to the first level for insertion of the pins on the button support in the holes in buttons when the radius arm is in its first angular position. However, as the radius arm of this transfer apparatus, at least, is exposed and subjected to rapid movement, there is a danger of an operator coming into contact with this radius arm and it is an object of the invention to overcome this safety hazard.

Buttons are also commonly formed with a convex under surface and the under surface of the periphery of the button is relieved more than the upper surface adjacent the periphery. It is therefore important that these buttons are correctly arranged with their upper surfaces uppermost.

Apparatus is therefore provided for achieving this and comprises a track along which buttons are able to move, in single file, and guide means which permit buttons with their upper surfaces uppermost to proceed along the track and which enable upside-down buttons, with their under surfaces upper most, to be deflected laterally of the track.

In one known form of such apparatus, the guide means are provided at a narrowed portion of the track and comprise a series of laterally projecting fingers which are spaced apart, along the length of the track, by a distance of less than the diameter of the buttons to be sorted. Buttons with their upper surfaces uppermost are therefore adequately supported as they progress along the track. However, these upper surfaces are formed with a central concavity so that when the buttons are upside-down, with their under surfaces uppermost, the central concavities pass across the ends of the laterally projecting fingers so that these fingers are unable to support the upside-down buttons which therefore topple sideways, off the track.

However, this form of apparatus can only be utilised with buttons formed with central concavities in their upper surfaces and it is an object of the present invention to overcome this deficiency.

DISCLOSURE OF THE INVENTION

According to the invention, there is provided apparatus, for orientating buttons formed with at least two thread holes, comprising an upwardly biased button support movable along a vertical axis between a lower position in which the button support is free to rotate about the vertical axis relative to a button on positioning means above the button support, an intermediate position in which the button support is free to rotate about the vertical axis together with a button on the positioning means, and an upper position in which the button support is locked against further rotation so as to provide support for buttons in the required orientation; pins projecting upwardly from the button support, for insertion in the holes in a button; and rotary frictional drive means for effecting relative rotation between the button support and a button on the positioning means until the pins on the button support are aligned with the holes in the button to thereby permit the button support to rise and the pins to enter the holes.

The button support and mounting means for the button support are preferably provided with vertically engaging parts which are engageable to permit movement of the button support from the intermediate position to the upper position, but which prevent this movement unless the button support is arranged to provide a support for buttons in the required orientation. In this case first resilient loading means can be provided for upwardly biasing the mounting means for the button support, and second resilient loading means can be provided for urging the vertically engageable parts into engagement with a force less than the force exerted by the first resilient loading means for the button support.

The invention also provides button transfer apparatus, for transferring correctly orientated buttons from a button orientating apparatus to a sewing machine, comprising an upwardly biased radius arm having a free end and support means permitting rotary oscillation about a vertical axis; a button support mounted at the free end of the radius arm and provided with upwardly extending pins for insertion into the holes in buttons; rotary drive means for effecting rotary oscillation of the radius arm about the vertical axis between first and second angular positions in which the button support is able to engage a correctly orientated button and in which a button engaged by the button support can be clamped in a sewing machine; cam means connected to the rotary drive means for lowering the radius arm from a first level to a second level when the radius arm is in its second angular position and enabling the radius arm to rise from the second level to the first level for insertion of the pins on the button support in the holes in buttons when the radius arm is in its first angular position; and overload release transmission means effective to rotate the radius arm into and out of its first and second angular positions or until movement of the radius arm is otherwise resisted by a predetermined obstructing force and to move the radius arm downwards, against the upward biasing, on interruption of angular movement of the radius arm between its first and second positions.

These overload release transmission means serve as a safety device to prevent or minimise injury as a result of an operator obstructing movement of the radius arm.

According to the invention, there is also provided apparatus, for orientating buttons in which the under surface adjacent the periphery is relieved more than the upper surface adjacent the periphery, comprising a track along which the buttons are able to move, in single file; and guide means in the form of a member extending across the track and having a deflecting surface which is inclined to the axis of the track for engagement with the peripheral edges of upside-down buttons so as to cause said upside-down buttons to be deflected laterally of the track on further movement of upside-down buttons along the track, but which will not prevent movement of buttons with their upper surfaces uppermost from riding over the member.

In a preferred embodiment, the member is a piece of plate and the deflecting surface is provided by an edge of this piece of plate.

Apparatus embodying the features of the invention are hereinafter described, by way of example only, with reference to the accompanying drawing.

MODES FOR CARRYING OUT THE INVENTION

Figures 1, 2, 3, 4, 5, 6:
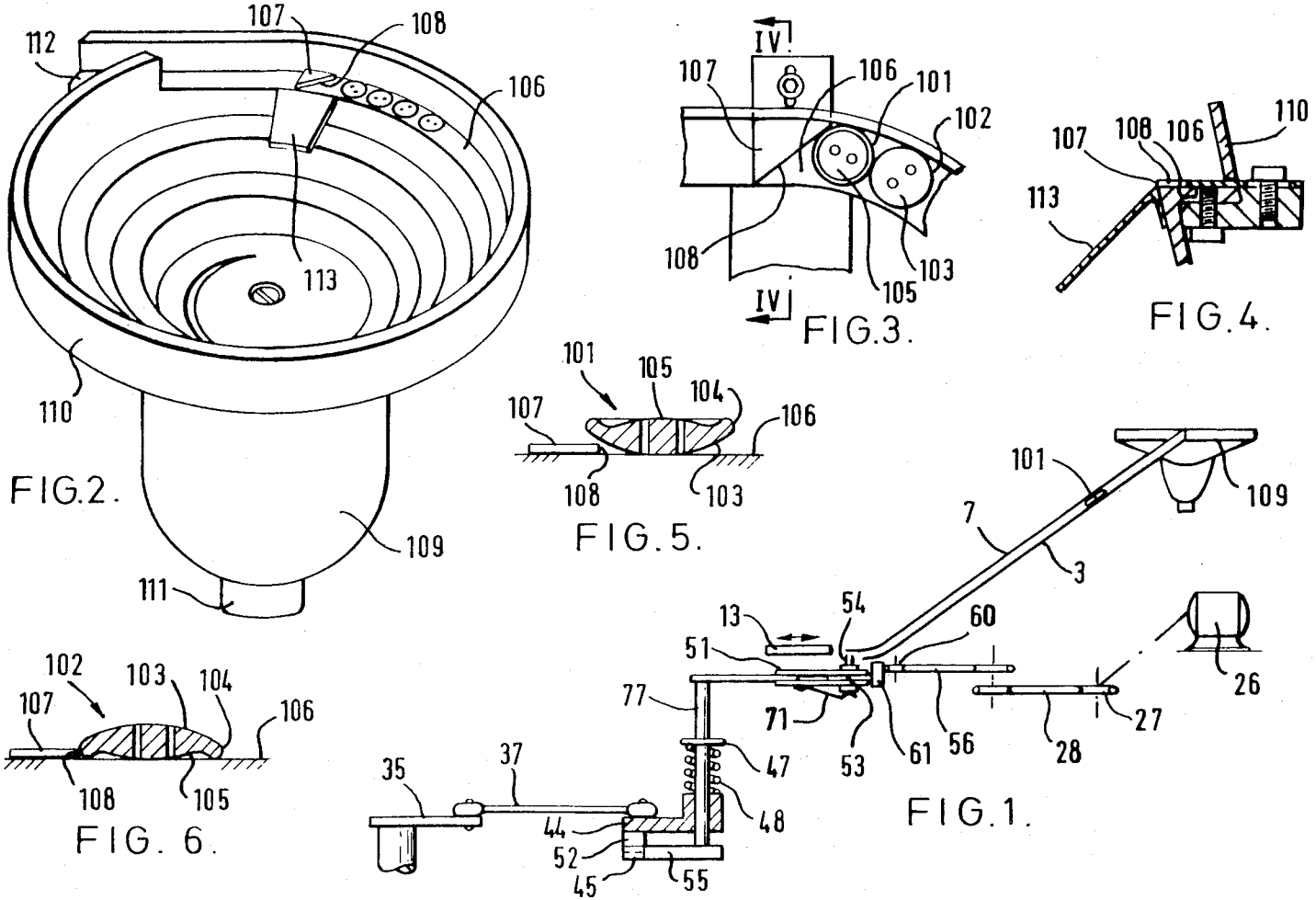
FIG. 1 is a schematic view of a button dispensing apparatus for supplying properly orientated buttons to a sewing machine.
FIG. 2 is an isometric view of a bowl feeder, forming part of the button dispensing apparatus shown in FIG. 1.
FIG. 3 is a plan view of part of the bowl feeder shown in FIG. 2.
FIG. 4 is a sectional view taken across the Section IV—IV shown in FIG. 3.
FIGS. 5 and 6 are schematic sectional side elevations of buttons mounted on the bowl feeder shown in FIG. 2.

Referring to FIG. 1, buttons 101 which are the right way up, with their upper surfaces uppermost, are discharged from the receptacle 109 of a vibratory bowl feeder and fed by means of an inclined chute 3 provided with a top guide rail 7 to an orientating position at the bottom end of the chute 3 where successive buttons 101 are clamped in position against a spring loaded stop 13.

An arm assembly 49 extending radially from a shaft 77 which is capable of rotary oscillation and axial reciprocation carries a button support in the form of a wheel 53 supports two pins 54 for reception in the holes of buttons 101. A rotary crank 35 is connected by means of a connecting rod 37 to an oscillatory crank 44 mounted on shaft 77 to effect swinging movement of the arm assembly 49. Thus, a dog 52 on the crank 44 is engageable with a cam 45 on arm 55 attached to the shaft 77 to move the arm assembly 49 away from the button orientating position at the bottom end of the chute 3. Stop means 50 (FIG. 10) limit this swinging movement of the arm assembly 49 when the wheel 53 is aligned with a button clamp (not shown) at the button sewing station of a sewing machine and, on further rotation of the crank 35, dog 52 rides over cam 45 and so causes depression of the shaft 77 against the upward influence of a helical compression spring 48 between a collar 47 on the shaft 77 and the crank 44. The pins 54 carried by the wheel 53 are thus withdrawn from a button 101 held by the button clamp at the button sewing station. Continued rotation of the crank 35 causes the arm assembly 49 to swing back until the wheel is re-aligned with the button orientation position at which stage continued movement of the arm assembly 49 is arrested by means of a stop (not shown) and continued rotation of crank 35 causes disengagement of the dog 52 from the cam 45, thus allowing arm 55, shaft 77 and arm assembly 49 to rise and allow the pins 54 carried by the wheel 53 to press upwardly on the underside of a button 101 in the button orientating position.

A capstan 61 driven by an electric motor 26 through urethane belts 28 and 56 trained over pulleys 27 and 60 is pressed into radial engagement with the periphery of wheel 53 to provide a frictional drive for rotating the wheel 53 until the pins 54 are brought into alignment with the holes in the button 101 in the orientating position. The shaft 77 and arm assembly 49 are then able to complete their upward movement under the influence of spring 48.

When the button 101 engaged by the pins 54 has been rotated into its correct orientation, means (shown more clearly in FIGS. 12 and 17) permit the pins 54 to rise still further, under the influence of leaf spring 71, into a position in which further rotation of the pins 54 is prevented. At this stage, crank 35 is caused to complete a further rotation, thus effecting a further cycle of swinging movement of the arm assembly 49, as hereinbefore described.

As shown in FIG. 2, the bottom receptacle 109 of the bowl feeder has a flared rim 110 formed on its inner surface with a helical spiral track 106 for buttons 101 and 102 from the receptacle 109. Movement of buttons 101 and 102 up the track 106 is effected by vibratory drive means 111 comprising solenoid means (not shown) for periodically pulling the receptacle 109 downwards into a first position while, at the same time, rotating the receptacle 109 in a clockwise direction, as viewed from above. On periodic release of the solenoid means, spring means (not shown) jerk the receptacle 109 upwards and rotate it in an anti-clockwise direction, as viewed from above. This causes buttons 101 and 102 to lodge on the track 106 and to progress upwards, along the track 106, in an anti-clockwise direction.

As shown in FIG. 4, the surface of the track 106 is inclined so as to urge buttons 101 and 102 outwards and to seat more securely on the track 106. However, when the buttons 101 and 102 reach the plate 107 laid across the track 106, upside-down buttons 102, having their undersides 103 uppermost are deflected radially inwards by the deflecting surface 108 provided by the inclined edge of the plate 107 which engages the periphery 102 of each upwide-down button 102, as shown in FIG. 6. Buttons 101, which are the right way up, with their upper surfaces 105 uppermost are able to ride over the plate 107 as a result of the greater relief provided on the under surface 103 adjacent the periphery 104. This is clear from FIG. 4. Buttons 101, which are the right way up, therefore issue from the bowl feeder at the outlet end 112 of the track 106 whereas upside-down buttons 102 fall back into the receptacle 109 via chut 113. It is therefore possible to discard upside-down buttons 102 even though the buttons 101 and 102 have no central concavity formed in their upper surfaces 105.

Figure 7:
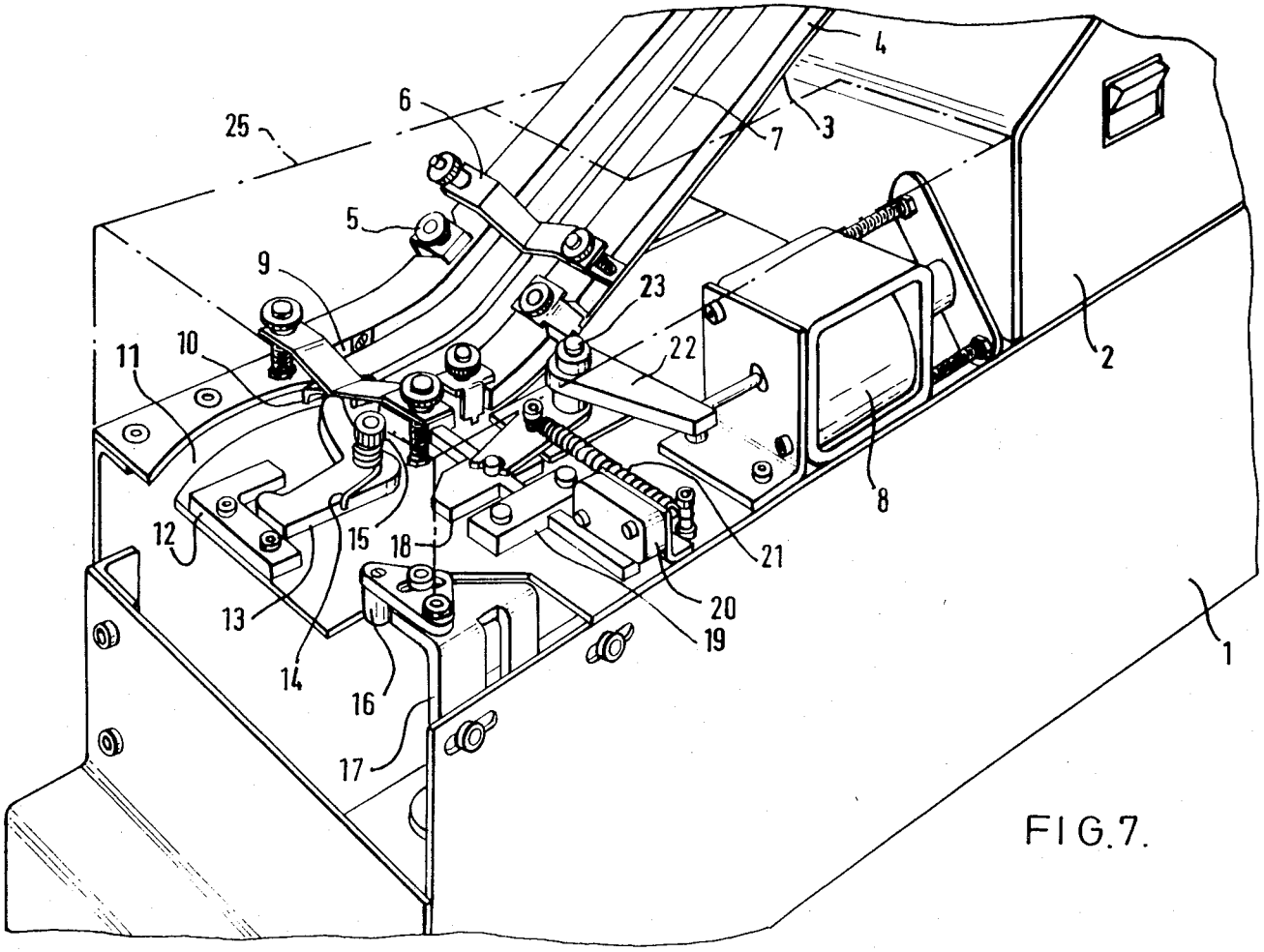
FIG. 7 is an isometric view of part of a button orientating apparaus forming part of the button dispensing apparatus shown in FIG. 1.
Figures 8, 9, 10:
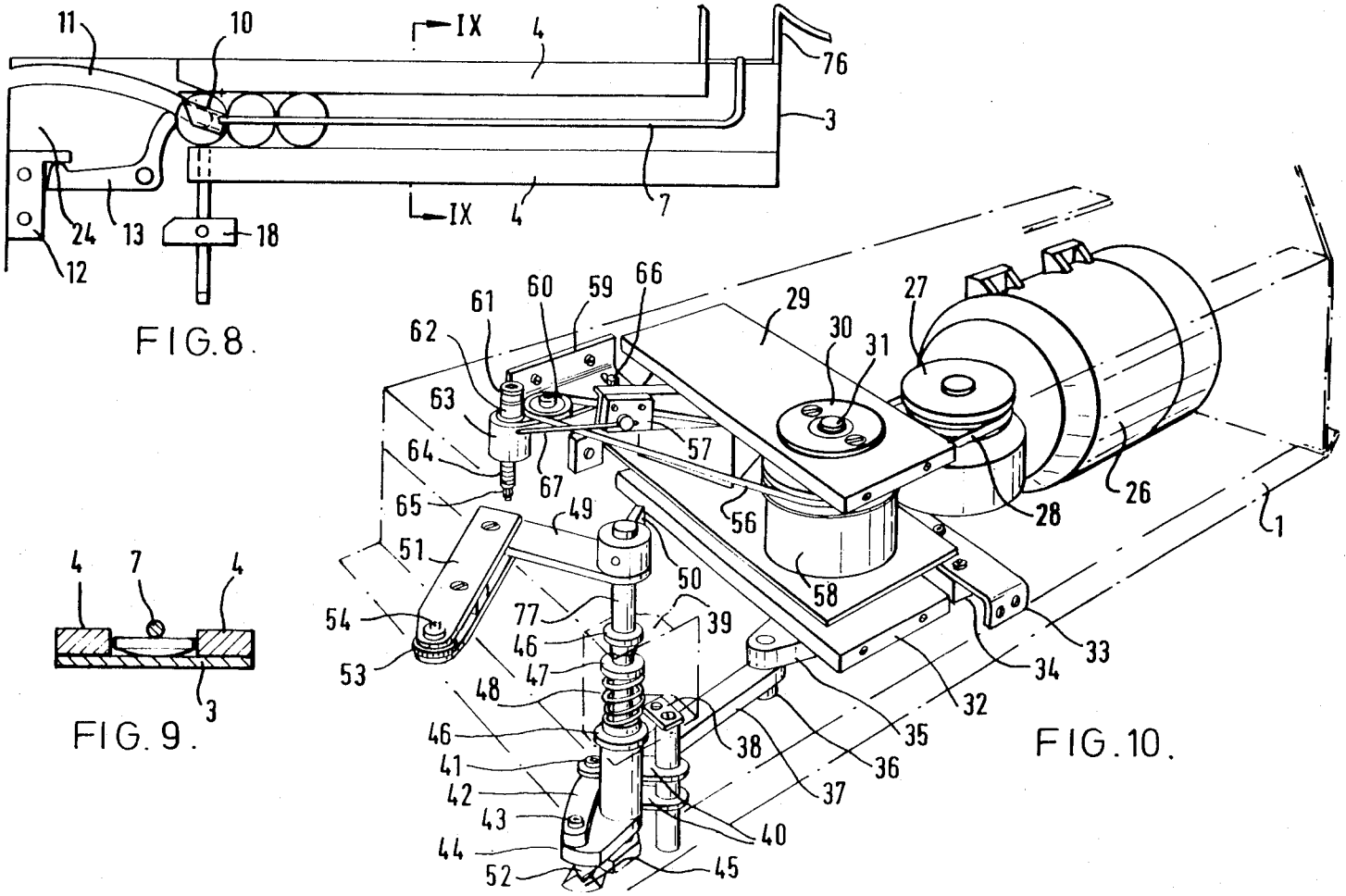
FIG. 8 is a plan view of part of the button orientating apparatus shown in FIG. 7.
FIG. 9 is a sectional view taken across Section IX—IX shown in FIG. 8.
FIG. 10 is an isometric view of part of the button orientating apparatus operable with those parts of the apparatus shown in FIGS. 7 to 9.
Figure 11:
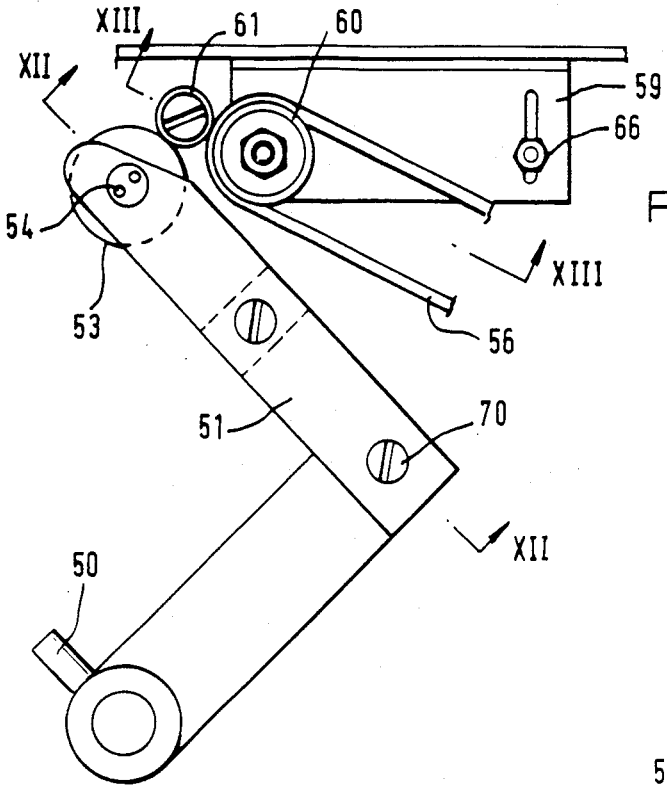
FIG. 11 is a plan view of an arm assembly forming part of the apparatus shown in FIG. 10.

Sorted buttons from the bowl feeder shown in FIG. 2 are fed from the outlet end 112 of the track 106 to the apparatus shown in FIGS. 7 to 15 where they travel down the inclined chute 3, shown in FIGS. 1, 7 and 8. This chute is adjustable in width by movable side guides 4. These are held in the correct position for a given button diameter by clamps 5. An adjustable top guide rail 7 is provided to allow for different button thicknesses and this is held in position by screws 6. The buttons queue down the chute butting up against each other. The button at the bottom end of the chute is pushed by the other buttons against adjustable spring-loaded stop 13 and is also clamped in position by the solenoid operated clamp 18. The clamp motion is derived from solenoid 8 via lever 22 and pivot 23. A spring 21 is provided to release the clamp 18 when power to the solenoid 8 is cut off. Micro-switch 20 detects the position of the clamp 18.

With the button now clamped in position, pins 54 on orientation wheel 53 are pushed up from below the button 101 through a slot 11 in the upper support surface of the apparatus. The button 101 is prevented from lifting by top guide channel 10 and the wheel 53 is turned by capstan 61. When the pins 54 locate with the button holes they are pushed through the button by the upward movement of the whole arm assembly 49. In the embodiment illustrated in FIG. 12, the wheel 53 then further turns until holes 69 in the wheel 53 align with pegs 68 and the leaf spring 71 pushes the wheel home onto the pegs 68. The button is now correctly orientated ready for placing into the sewing machine clamp (not shown). This condition is detected by the wire arm 67 (FIG. 10) of micro-switch 57 which rests on the upper surface of the rim of wheel 53. The whole arm assembly 49 then rotates through approximately 150° and the button is conveyed with it located on pins 54. During this operation, as the button leaves the bottom of the chute 3, it pushes spring loaded stop 13 from its path. As the arm assembly 49 reaches the end of its travel the button slides into the sewing machine button clamp from the rear of the clamp and is gripped on each side by the clamp. The arm assembly 49 then drops down approximately 5 mm and swings back to its initial starting position at the bottom of the chute 3.

While the arm assembly 49 is swinging forward to place the button in the sewing machine clamp, solenoid operated clamp 18 moves towards the middle of the chute 3 to prevent further buttons from sliding down to the bottom position. Once the button is clear of stop 13, the stop 13 springs back to its original position by pivoting around pivot 15, under the influence of spring 14, and is arrested by adjustable striker plate 12 which controls its final position in accordance with the button diameter.

While stop 13 is resetting, clamp 18 trips micro-switch 20 and clamp 18 resets to allow the next button to the bottom of the chute. Just before the arm assembly 49 returns to its starting position at the bottom of the chute 3, clamp 18 re-clamps as micro-switch 34 is tripped by crank 35. Micro-switch 34 is mounted on bracket 33. The cycle then repeats on demand controlled by the sewing machine. The relevant conditions being that the sewing machine clamp is in the rest position ready to accept a button and that the sewing machine has just operated.

The main drive for the unit is provided by a geared electric motor 26 housed within the main body 1 of the machine. On the motor gearbox output spindle is mounted a pulley 27 which drives via a urethane belt 28 a pulley mounted on wrap spring clutch 58. When this clutch 58 is engaged it drives shaft 31 which is mounted in bearings 30 situated in plates 29 and 32.

On the lower end of the shaft 31 is mounted crank 35 with a pivot pin 36. Each time the machine completes a cycle, this crank 35 does one revolution moving connecting rod 37, radius arm 40, and radius link 42 to drive crank 44 through approximately 180° and return it. The connecting rod 37 and radius link 42 are pivoted on pins 41 and 43 and the main pivot for the radius arm 40 is pin 38.

Crank 44 is bushed to turn freely on the shaft 77 to operate cam 45 and, as the crank 44 is driven forward at the start of the cycle, a dog 52 below the crank 44 rests against the side of a cam 45 carried by arm 55. Stop 50, on arm assembly 49 strikes an adjustable stop 16 to arrest the rotation of arm 55 approximately 15° before the rotation of crank 44 is arrested. This co-incides with the button being placed in the sewing machine clamp and, as the crank 44, is forced around, cam 45 is forced downwards by the inclined face of the dog 52, thus pulling the arm 55 and the arm assembly 49 downwards against the action of spring 48.

The dog 52 then engages in the notch 78 on the top of cam 45 and, as crank 44 returns, it pulls arm 55 and arm assembly 49 with it in this lowered position. When arm assembly 49 is back below the chute 3, at its initial starting position, the stop 50 on the arm strikes adjustable stop 17. Crank 44 continues to move, through a further 15°, forcing the dog 52 to disengage from cam 45 and allowing the arm 55 and arm assembly 49 to spring upwards below the button at the bottom of the chute 3.

The shaft 77 of cam 45 is pivoted in plastic bushes 46 retained in housing 39 and is spring loaded by spring 48, acting against collar 47. It should be noted that the dog 52 and cam 45 drive arrangement between crank 44 and arm 55, ensures that in the event of any obstruction occurring between the sewing machine clamp and the arm assembly 49, then the crank 44 will override the arm 55, and then automatically re-set on the return stroke as both dog 52 and cam 45 are double sided. This is a valuable safety feature which will prevent any possibility of injury to machinists hads whereas other units have completely positive drives which are obviously inherently more dangerous.

Figure 12:
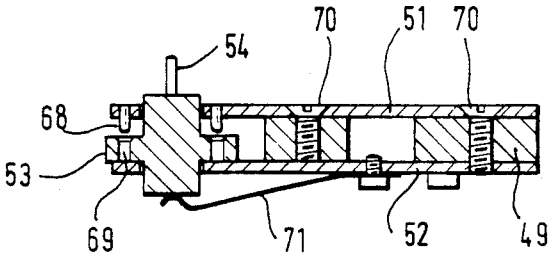
FIGS. 12 and 13 are sectional elevations taken across the Sections XII—XII and XIII—XIII in FIG. 11.
Figure 13:
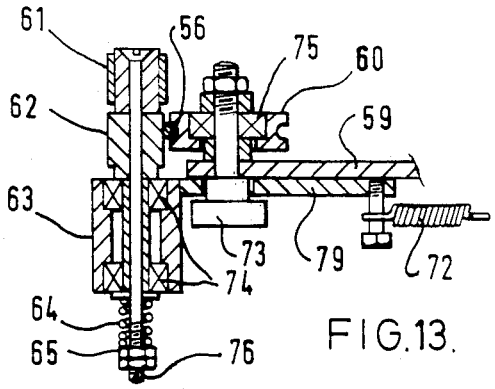
Figure 14:
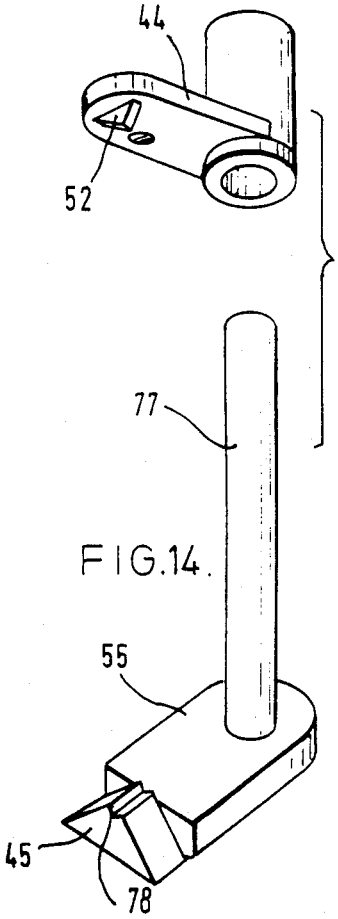
FIG. 14 is an exploded isometric view of part of the arm assembly shown in FIG. 11.
Figure 15:
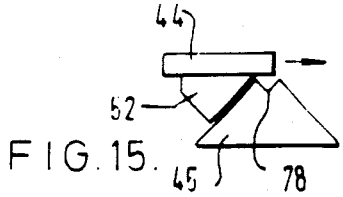
FIGS. 15 and 16 are end views of cam means forming part of the arm assembly shown in FIG. 10, respectively disposed for transmitting rotational movement and after transmitting rectilinear movement on termination of rotational movement.
Figure 16:
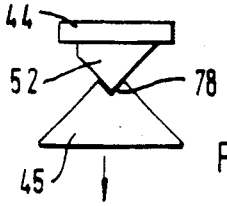
Figure 17:
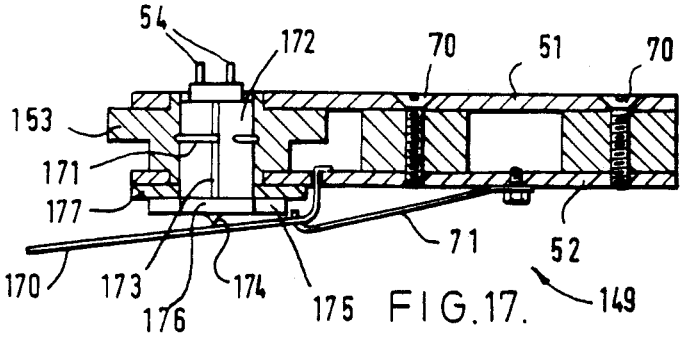
FIG. 17 is a sectional elevation of a modified arm assembly forming part of a button orientating apparatus in accordance with the invention.

In a preferred embodiment of the invention, the arm assembly 49, shown in FIG. 12, is replaced with an arm assembly 149 as shown in FIG. 17.

Wheel 153 of the arm assembly 149 has a central core 172 carrying the pins 54 and is frictionally coupled to the wheel 153 by means of a spring clip 171 which is seated in a groove in the bore of the wheel 153 and hooked into a longitudinal slot 173 formed in the core 172. The core 172 is therefore able to move longitudinally of the wheel 153 under the influence of leaf spring 71 acting on lever 170 which is pivoted to the lower plate 52 and bears against a projection 174 on the bottom of the core 172.

The core 172 is formed with a flange 175 at its lower end and this flange 175 is formed with two flats 176. Two plates 177 and 178 secured to the lower plate 52 define therebetween a groove equal in width to the diameter of the core 172 for receiving the flange 175.

Thus, when the arm assembly 149 has been swung into a position in which the wheel 153 is below a button 101 in the button orientating position and has been allowed to rise until the pins 54 bear against the button 101, rotation of the wheel 153 brings the pins 54 into alignment with the hole in the button 101 and so the arm assembly 149 is able to rise still further.

Although the leaf spring 71 urges the core 172 upwards, this movement is prevented by engagement of the flange 175 with the plates 177 and 178. However, on continued rotation of the wheel 153 and the core 172, the flange 175 comes into alignment with the groove between the plates 177 and 178, thus allowing the core 172 to rise under the influence of leaf spring 71. Thereafter, core 172 is blocked against rotation, relative rotation between the wheel 153 and core 172 being taken up by slippage of the spring clip 171 in the groove formed in the bore of the wheel 153.

With the core 172 blocked relative to the arm assembly 149, with the pins 54 in their proper orientation, the arm 149 is able to swing forward so as to carry a button 101 mounted on the pins 54 into the button sewing station.

In an alternative arrangement, the cam 45 and dog 52 are replaced by alternative means comprising a cam and dog mechanism contained within the arm assembly 49 and formed by splitting the stop 50 and the boss to which the stop 50 is attached. The upper part of this split boss is secured to the shaft 77 of cam 45 and the lower surface of the upper part of the split stop forms a dog which engages a notch in the upper surface of the lower part of the split stop. The lower part of the split boss, carrying the arm assembly 49, is free to rotate on the shaft 77 of the cam 45, but is spring loaded upwards to hold the dog and not in engagement. However, if the arm assembly 49 is prevented from rotating during rotation of the shaft 77, the dog and notch will disengage to allow relative movement between the upper and lower parts of the split bush.

Figure 18:
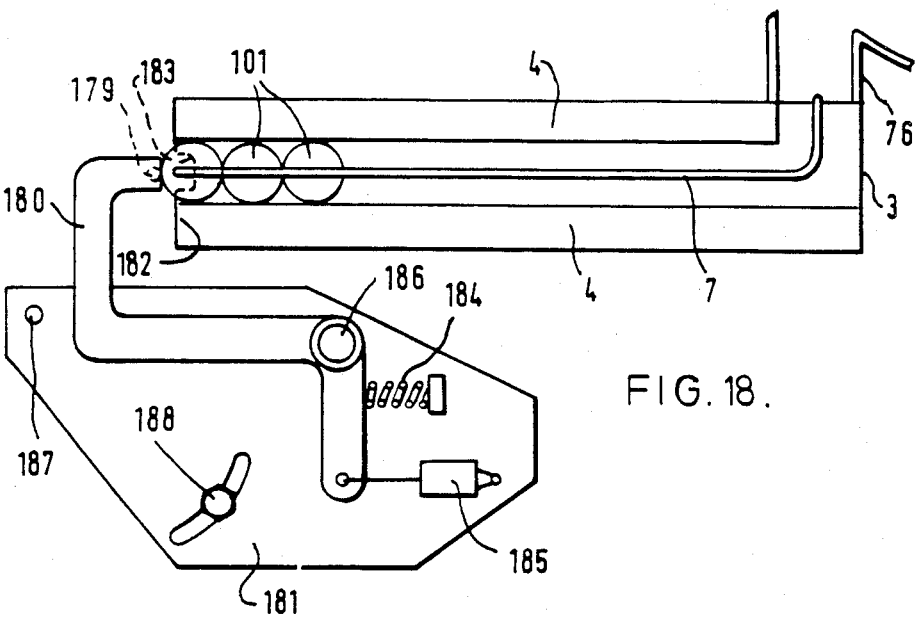
FIG. 18 is a plan view of a modified part of a button orientating apparatus in accordance with the invention.
Figure 19:
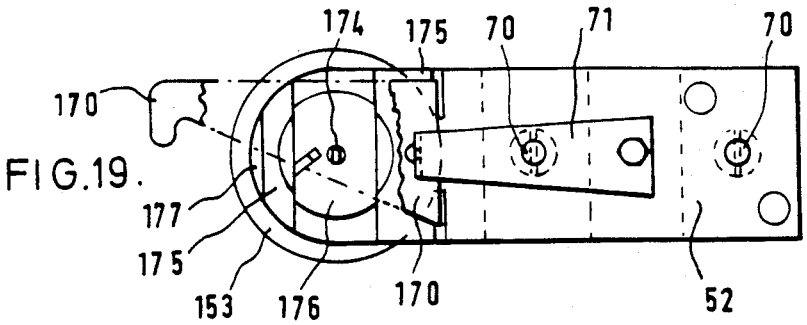
FIG. 19 is a plan view of the bottom of the modified arm assembly shown in FIG. 17.

In a preferred embodiment of the invention, in which alternative means are provided for dispensing buttons 101 from the bottom of chute 3, the spring-loaded stop 13 and clamp 18 shown in FIG. 7 are replaced with a solenoid operated spring-loaded movable stop 179, as shown in FIG. 18.

The movable stop 179 shown in FIG. 18 is mounted on a cranked lever 180 which is pivotally supported about a peg 186 on a base 181 which itself is pivoted about a peg 187 at one corner, on loosening locking screw 188, for angular adjustment relative to the underlying structure. By this means, it is possible to simply vary the blocking position of the stop 179 to engage buttons 101 of different sizes so that the end button 101 on the chute 3 comes to rest against the stop 179 when between one quarter and one half of the button 101 projects beyond the end 182 of the chute 3. To enable the pins 54 of button 101 at the button orientating position at the bottom of the chute 3, the end 182 of the chute 3 is formed with a part-circular notch 183.

A compression spring 184 extending between the lever 180 and the base 181 urges the movable stop 179 against the lowermost button 101 at the bottom of the chute 3 so that, when this button 101 is carried away on the pins 54 of the wheel 53 or the wheel 153, the stop 179 returns to its original position before further buttons 101 can slide down the chute 3 and over the edge 182 of the chute 3. However, when it is necessary to effect rapid removal of buttons 101 from the chute 3, so that the chute 3 can be filled with different buttons or to remove a button 101 which is causing an obstruction, a solenoid 185 is operable to move the lever 180 so that the movable stop 179 clears the end of the chute 3.

The buttons 101 which fall from the chute 3 are caught in a hopper (not shown).

By this means, it is possible to remove buttons 101 much more rapidly than by performing a series of consecutive button transfer operations in accordance with the normal operation of the apparatus.

A selection of wheels 53 will be provided with pins 54 at different pitches to suit different thread hole spacings. These wheels 53 can be readily exchanged by the machinist by undoing screws 70 retaining top plate 51 of the arm assembly 49, removing wheel 53, exchanging it, and re-assembling.

The drive for rotating the wheel 53, when locating the button at the bottom of the chute 3 is provided by capstan 61. This capstan 61 is spring loaded by spring 72 which acts between a peg on housing plate 79 and peg 66 on mounting bracket 59.

This spring loading is arranged to push the capstan 61 onto the wheel 53 and to push the capstan drive spindle 62 onto the urethane belt 56, where it passes around pulley 60. The urethane belt 56 is driven from the continuously revolving input pulley on wrap spring clutch 58. The pulley 60 rotates on ball bearing 75 which is mounted on pivot pin 73.

Capstan drive spindle 62 rotates between two bearings 74 mounted in housing 63. Through the centre of capstan 61 and spindle 62 pass a tension screw 76 which pulls capstan 61 down onto spindle 62, under the action of spring 64 bearing on the nut 65. Thus, the capstan spindle 62 and capstan 61 revolve continuously at all times while the electric motor 26 is switched on. This will revolve wheel 53, when it is pressed against the capstan 61, until such time as holes 69 engage on pegs 68, when wheel 53 will stop turning and the capstan 61 will remain static and slip on the upper face of spindle 62, thus providing a simple friction clutch.

A leaf spring 9 on the side of guide rail 4, at the bottom of the chute 3 is deflected sideways to allow for the angularity of the exit of the button on arm assembly 49, as it passes along slot 11.

A main control panel 2 incorporates the following controls:

(a) A mains on/off switch for the vibratory feeder and the button placing machine.

(b) The vibratory feeder controls.

(c) A potentometer for adjusting the force of clamp 18, produced by solenoid 8.

(d) An indicator lamp operated on actuation of micro-switch 20 by clamp 18 to show the fault condition "no button available at the bottom of the chute".

(e) An indicator lamp operated by micro-switch 57 to show the fault condition "button at bottom of chute will not locate on pegs 54".

(f) A push button to eject a defective button as indicated by condition (e). This will work by firstly cycling the unit to move arm assembly 49, clear of the bottom of the chute and then energising solenoid 8, at full power by bypassing the potentometer so that clamp 18 pushes the button out sideways from the end of the chute 3.

(g) A push button to manually initiate the unit to cycle, where the cycle cannot be initiated by releasing movement of the sewing machine clamp, so that the sewing mchine can be loaded with the first button at commencement of work and, at the end of work, to clear any buttons remaining in the chute 3.

I claim:

1. Apparatus, for orientating buttons formed with at least two thread holes, comprising:

an upwardly biased button support;

pins projecting upwardly from the button support, for insertion in the holes in a button;

positioning means for positioning a button above the button support; and rotary frictional drive means for effecting relative rotation between the button support and a button located on the positioning means until the pins on the button support are aligned with the holes in the button to thereby permit the button support to rise and the pins to enter the holes;

wherein the button support is movable along a vertical axis between a lower position in which the button support is free to rotate about the vertical axis relative to a button located by the positioning means, an intermediate position in which the button support is free to rotate about the vertical axis together with a button located by the positioning means, and an upper position in which the button support is locked against further rotation so as to provide a support for buttons in the required orientation.

2. Apparatus, according to claim 1 further comprising mounting means for the button support, the button support and the mounting means for the button support being provided with vertically engaging parts which are engageable to permit movement of the button support from the intermediate position to the upper position, but which prevent this movement unless the button support is arranged to provide a support for buttons in the required orientation;

first resilient loading means for upwardly biasing the mounting means for the button support; and second resilient loading means for urging the vertically engageable parts into engagement with a force less than the force exerted by the first resilient loading means on the mounting means for the button support.

3. Apparatus, according to claim 2, in which the vertically engaging parts comprise complementary, axially-directed pins and apertures.

4. Apparatus, according to claim 2, in which the button support comprises a wheel and a central core whuich is movable, both axially and rotationally, relative to the wheel and the vertically engaging parts comprise a cross-member at the bottom of the core and a groove between two plates on the bottom surface of the arm assembly.

5. Button transfer apparatus, for transferring correctly orientated buttons from a button orientating apparatus to a sewing machine, comprising:

an upwardly biased radius arm having a free end and support means permitting rotary oscillation about a vertical axis;

a button support mounted at the free end of the radius arm and provided with upwardly extending pins for insertion into the holes in buttons;

rotary drive means for effecting rotary oscillation of the radius arm about the vertical axis between first and second angular positions in which the button support is able to engage a correctly orientated button and in which a button engaged by the button support can be clamped in a sewing machine; and cam means connected to the rotary drive means for lowering the radius arm from a first level to a second level when the radius arm is in its second angular position and enabling the radius arm to rise from the second level to the first level for insertion of the pins on the button support in the holes in buttons when the radius arm is in its first angular position;

wherein overload release transmission means are effective to rotate the radius arm into and out of its first and second angular positions or until movement of the radius arm is otherwise resisted by a predetermined obstructing force and to move the radius arm downwards, against the upward biasing, or interruption of angular movement of the radius arm between its first and second angular positions.

* * * * *